US005080533A

United States Patent [19]

Cooper

[11] Patent Number: 5,080,533

[45] Date of Patent: Jan. 14, 1992

[54] SAFETY SHIELD FOR AN EXCAVATION TRENCH

[76] Inventor: Hugh E. Cooper, 1137 Tilton Park Dr., Rochelle, Ill. 61068

[21] Appl. No.: 579,162

[22] Filed: Sep. 7, 1990

[51] Int. Cl.[5] ..... E02D 17/08

[52] U.S. Cl. ..... 405/282; 405/272

[58] Field of Search ..... 405/150, 151, 153, 272, 405/282, 283, 285

[56] References Cited

U.S. PATENT DOCUMENTS

| | | | |
|---|---|---|---|
| 1,391,624 | 9/1921 | Gardner . | |
| 2,482,367 | 9/1949 | Ravers, Jr. et al. . | |
| 2,633,713 | 4/1953 | Shields . | |
| 2,777,294 | 1/1957 | Rosa et al. . | |
| 2,865,178 | 12/1958 | Wicke . | |
| 2,956,409 | 10/1960 | Wicke . | |
| 3,029,607 | 4/1962 | Millerbernd . | |
| 3,186,177 | 6/1965 | Kannenberg . | |
| 3,541,799 | 11/1970 | Jost et al. . | |
| 3,750,409 | 8/1973 | Orfei . | |
| 3,782,126 | 1/1974 | Pavese . | |
| 3,820,345 | 6/1974 | Brecht . | |
| 3,992,887 | 11/1976 | Fisher . | |
| 4,056,940 | 11/1977 | Fisher . | |
| 4,114,383 | 9/1978 | Nieber . | |
| 4,453,863 | 6/1984 | Sutton et al. | 405/282 |
| 4,659,260 | 4/1987 | Morelli . | |
| 4,752,157 | 6/1988 | Ischebeck et al. | 405/282 |
| 4,787,781 | 11/1988 | Bradberry | 405/282 |

FOREIGN PATENT DOCUMENTS

| | | |
|---|---|---|
| 1383953 | 11/1964 | France . |
| 1508801 | 11/1967 | France . |

OTHER PUBLICATIONS

Griswold Machine & Engineering, Inc., brochure; "Lite-Shield".

*Primary Examiner*—David H. Corbin

*Attorney, Agent, or Firm*—Rockey and Rifkin

[57] ABSTRACT

The safety shield of the invention consists of a plurality of vertical columns having horizontally disposed steps extending therefrom. The vertical columns are arranged in pairs along opposite walls of the trench. Horizontal sidewall members extend parallel to the walls of the trench and are located between the steps extending from the columns. Transverse bracing members are located between and supported by the columns of each opposed pair of columns. The transverse bracing members are pivoted at their midpoint and include pivotable clevises on opposite ends thereof to facilitate assembly and disassembly. Oversized holes formed on the steps of the vertical columns, horizontal sidewall members and transverse bracing members align with one another such that a single latchpin can be used to connect all three members together. Thus, the safety shield of the invention can be assembled quickly and easily.

11 Claims, 3 Drawing Sheets

FIG. 1
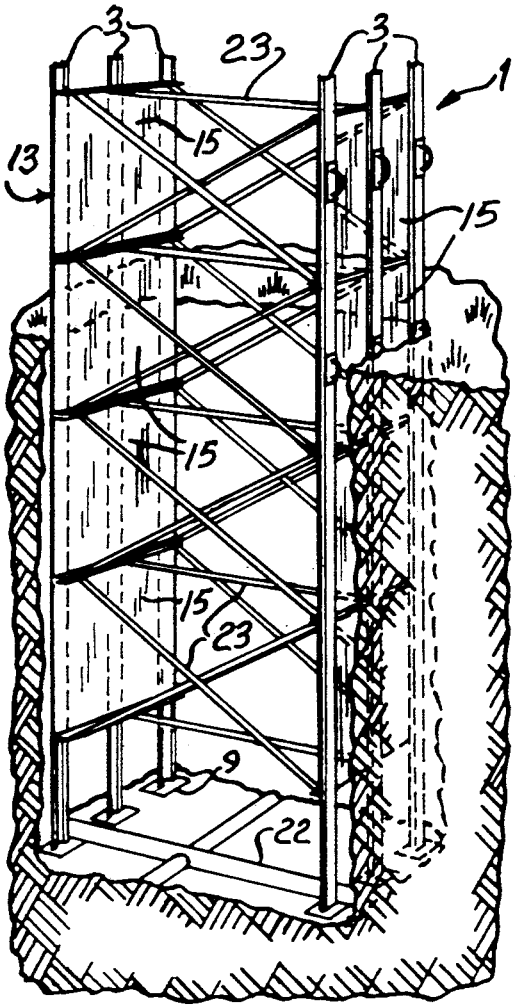
FIG. 2
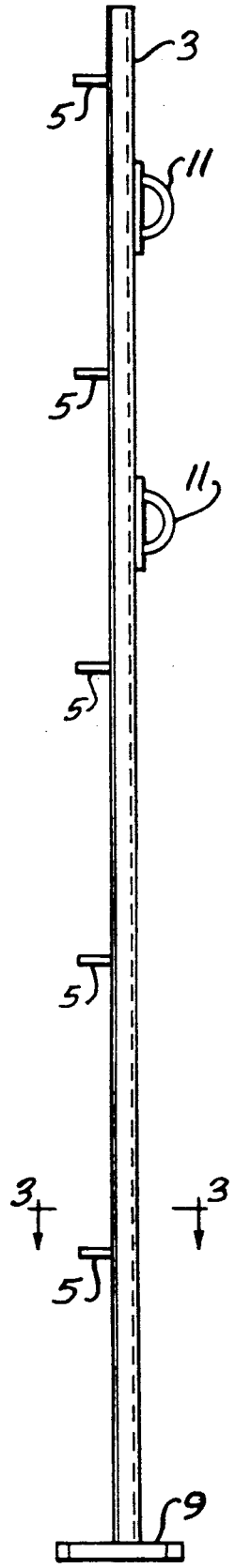
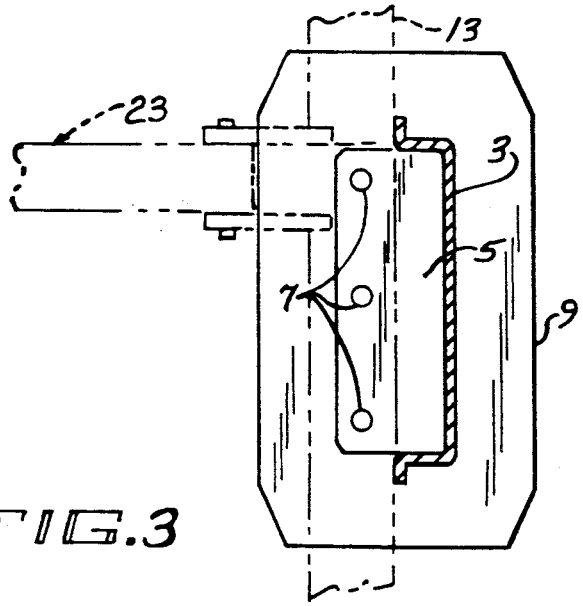
FIG. 3

SAFETY SHIELD FOR AN EXCAVATION TRENCH

BACKGROUND OF THE INVENTION

The invention relates, generally, to safety shields and, more particularly, to a safety shield that can be quickly and easily installed in an excavated trench to protect against cave-ins.

In order to repair or install underground systems such as water and sewage pipes or electrical and utility lines, it is often necessary for workers to enter an excavated trench in the area where the pipes or lines are located Because of the depths to which these trenches must be dug, a substantial risk of injury to the workers exists should the trench collapse In fact, OSHA has estimated that more than 100 fatalities and 5,000 serious injuries occur annually due to trench cave-ins. In addition to the human loss, extensive property damage can also result.

As a result, a wide variety of safety devices for reinforcing and supporting excavated trenches have been developed. Examples of such devices can be found in U.S. Pat. Nos. 4,659,260, 4,114,383, 3,029,607, 2,956,409, 2,482,367. Unfortunately, these prior art devices can be expensive to manufacture and difficult to transport and assemble. Therefore, a trench safety shield that is inexpensive to manufacture and easy to assemble, install and transport is desired.

OBJECTS OF THE INVENTION

It is a general object of the invention to provide an improved safety shield for trench excavations.

It is a further object of the invention to provide an improved safety shield that is lightweight such that the component parts can be easily carried by one person yet is strong enough to withstand a trench cave-in.

It is another object of the invention to provide an improved safety shield for a trench excavation that can be quickly assembled and easily transported.

It is still a further object of the invention to provide an improved safety shield for a trench excavation that is inexpensive to manufacture.

Other objects of the invention, in addition to those set forth above, will become apparent to one of ordinary skill in the art from the following detailed description of the invention.

SUMMARY OF THE INVENTION

The safety shield of the invention overcomes the above-noted shortcomings of the prior art and consists of a plurality of vertical columns having horizontally disposed steps extending therefrom. The vertical columns are arranged in pairs along opposite walls of the trench. Horizontal sidewall members extend parallel to the walls of the trench and are located between and supported on the steps extending from the columns. Transverse bracing members are secured between the columns of each opposed pair of columns. The transverse bracing members are pivoted at their midpoint and include pivotible clevises on opposite ends thereof to facilitate assembly and disassembly of the safety shield. Oversized holes formed on the steps of the vertical columns, the horizontal sidewall members and the clevises of the transverse bracing members are aligned with one another such that a single latchpin can be used to connect all three members together. Thus, the safety shield of the invention can be assembled quickly and easily.

BRIEF DESCRIPTION OF THE DRAWINGS

FIG. 1 shows a perspective view of the safety shield of the invention assembled in an excavation trench.

FIGS. 2 shows a detailed side view of the vertical columns of the invention.

FIG. 3 shows a section view of the vertical column taken along line 3—3 of FIG. 2 showing the position of a sidewall member and bracing number in phantom line.

DETAILED DESCRIPTION OF THE INVENTION

Figure 4:
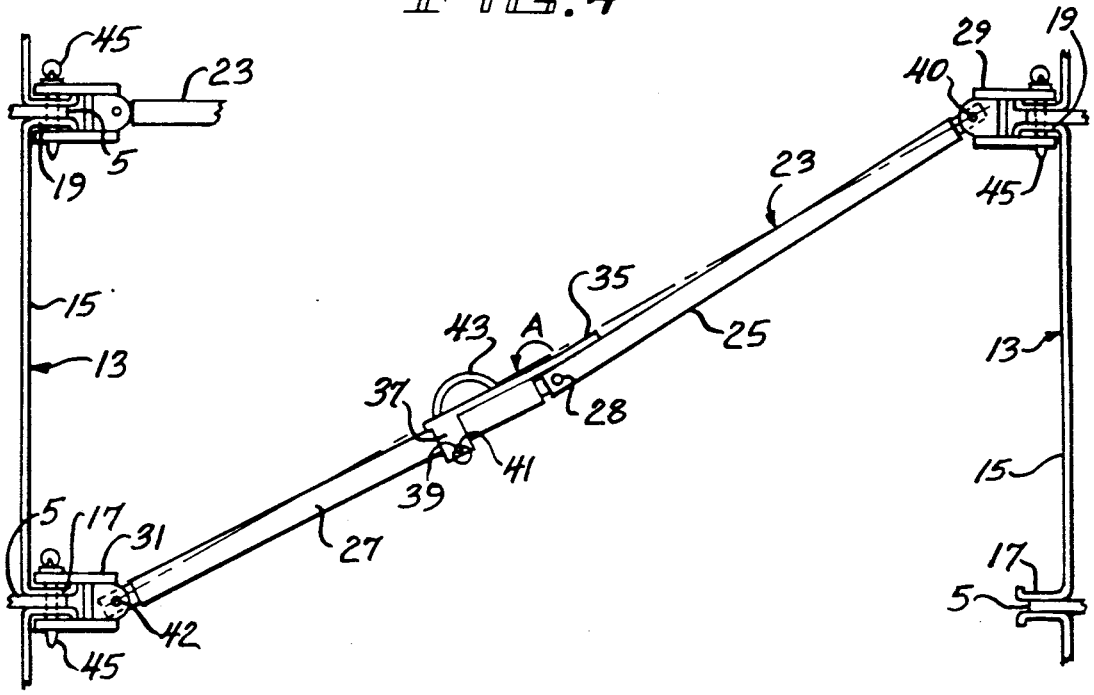
FIG. 4 shows a side view of the transverse bracing members of the invention.

Referring more particularly to FIG. 1, the safety shield of the invention is shown generally at 1 and includes a plurality of vertical columns 3 arranged in opposed pairs. The vertical columns 3 are formed of aluminum and have a generally U-shaped cross-section, shown in FIG. 3. As best shown in FIGS. 2 and 3, each column 3 has a plurality of flats welded thereto at spaced intervals to form a series of steps 5. The steps 5 extend perpendicularly from the vertical column 3 and have a plurality of spaced oversized holes 7 arranged in a linear configuration. In the preferred embodiment five steps are provided on each column; however, a fewer or greater member can be provided as desired. Welded to the bottom of each vertical column 3 is a flat which forms a footing 9 on which the column rests. It should be noted, that footing 9 can be eliminated without adversely affecting the stability of the safety shield 1. Finally, lift loops 11 are welded to the vertical columns 3 on the side opposite steps 5 to provide a convenient means for lifting and carrying the columns.

Figure 6:
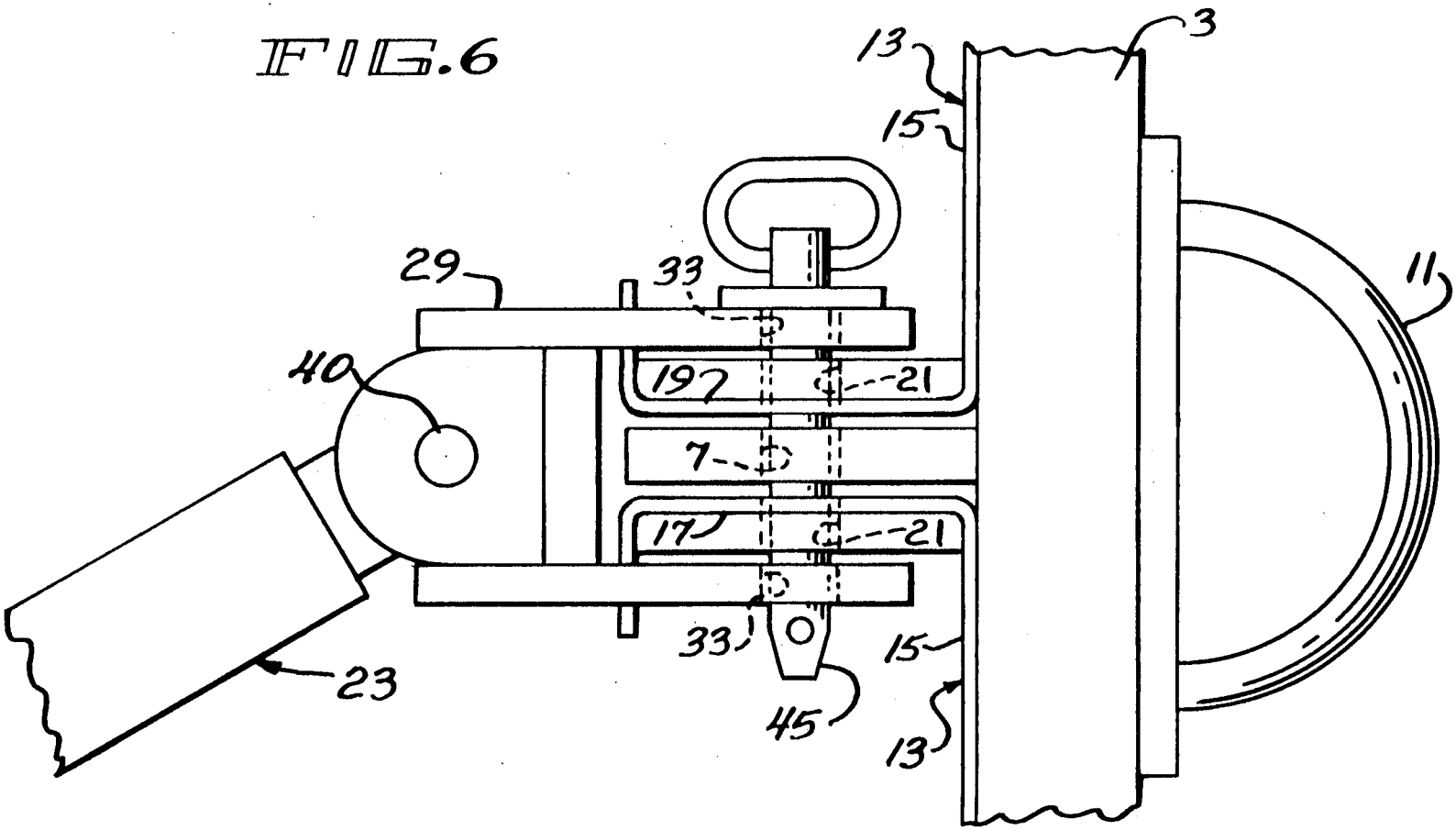
FIG. 6 shows a detailed view of the connection illustrated in FIG. 4.

Horizontal sidewall members 13 are formed of aluminum and consist of a planar wall portion 15 with flanges 17 and 19 extending from opposite edges thereof as best shown in FIGS. 1 and 4. Wall portion 15 is dimensioned such that the sidewall members 13 fit between adjacent steps 5 of the vertical columns 3 with a substantial clearance between flanges 17 and 19 and the adjacent steps 5 as best shown in FIG. 6. The clearance between flanges 17 and 19 and the steps 5 is such that the sidewall members 13 can be pivoted into position between the steps 5. Flanges 17 and 19 are provided with a plurality of oversized holes 21 arranged in spaced sets so as to be coextensive with holes 7 provided on the steps 5 when the sidewall members 13 are arranged on the columns 3.

In a preferred embodiment the lowermost sidewall member 13 is made narrower than the upper sidewall members such that if it is omitted, a narrow gap is created between the upper sidewalls and the ground as illustrated in FIG. 1. This narrow gap allows clearance for lines or pipes 22 running transverse to the safety shield where necessary.

Transverse bracing members 23 consist of a first section 25 pivotably connected to a second section 27 at pivot 28 as best shown in FIG. 4. First section 25 and second section 27 are constructed of square aluminum tubing and include clevises 29 and 31 pivotably mounted at pivots 40 and 42, respectively. The clevises 29 and 31 have oversized holes 33 formed therein which align with the holes formed in the sidewall members 13 and steps 5, as will hereinafter be described.

When the safety shield of the invention is fully assembled, the bracing members 23 are locked in the extended position shown in FIGS. 1 and 4. In order to lock member 23 in this position, a locking bar 35 is welded to first section 25. The locking bar 35 has a pair of extensions 37 provided with holes 39 that align with one another when bracing member 23 is in the extended position. A latchpin 41 is inserted into the aligned holes on the outside of second section 27 to lock bracing member 23 in the extended position. Moreover, in this locked position pivot 28 is located slightly offset from the center line of the pivots of clevises 29 and 31 such that the angle A between the second section 27 and the first section 25 is less than 180 degrees as shown in FIG. 4. Locking bar 35 extends over the pivot 28 and acts as a stop to prevent a further movement between sections 25 and 27 and is angled slightly away from second section 27 so as to allow section 27 to be slightly over center relative to section 25. Finally, a lift loop 43 is welded to locking bar 35 to provide a convenient means for folding member 23 once latchpin 41 is removed.

Figure 5:
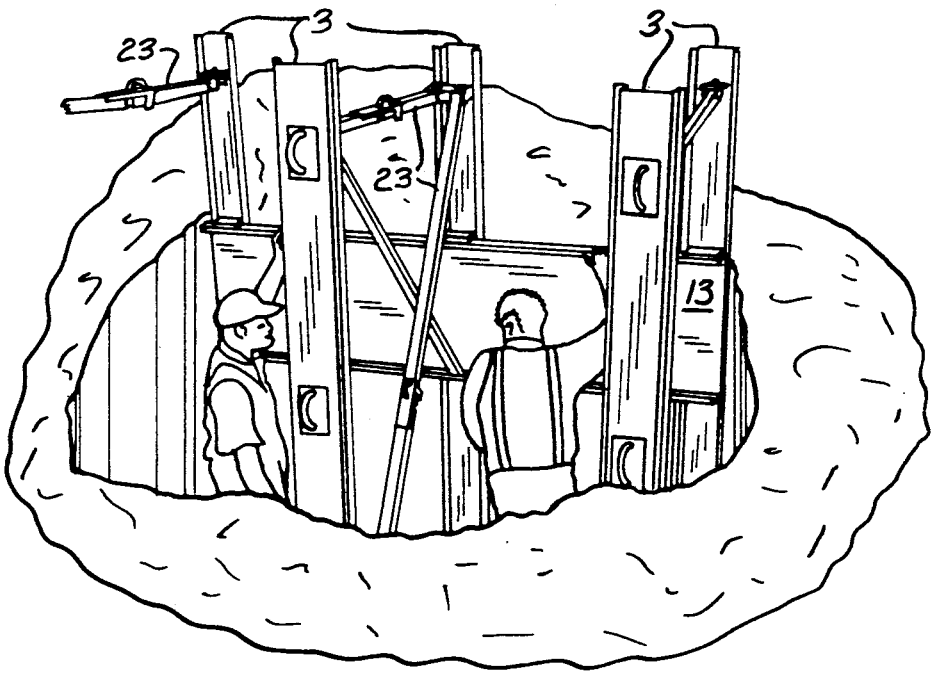
FIG. 5 shows a perspective view of the safety shield of the invention during the installation operation.

The assembly of the safety shield of the invention will be described with specific reference to FIGS. 1 and 5. Once a trench has been created by suitable excavation equipment, the vertical columns 3 are arranged in opposed pairs along the length of the trench. Shallow holes can be made to receive footings 9 and add greater stability to columns 3 if so desired. The columns 3 are spaced from one another such that the bracing members 23 span the distance between the paired columns and the holes 21 on the sidewall members 13 align with the holes 7 found on steps 5.

Once the columns 3 are properly located, the sidewall members 13 can be easily arranged between adjacent steps 5 because of the clearance between the flanges 17 and 19 and the steps 5. When the sidewall members 13 are properly aligned, holes 21 align with holes 7 found on steps 5. As is evident from the drawings, the safety shield of the invention can be of various heights by installing as many sidewall members 13 as desired.

The transverse bracing members 23 are arranged between the paired columns such that the holes 33 formed in clevises 29 and 31 align with the holes 7 and 21 formed in the steps 5 and bracing members 23, respectively. Holes 7, 21 and 33 are made oversized relative to latchpin 45 to allow latchpin 45 to pass therethrough even if the holes are not perfectly aligned. A single latchpin 45 is inserted through all three members such that the column 3, sidewall member 13 and bracing member 23 are secured to one another by a common member as shown in FIGS. 4 and 6. Moreover, it should be noted that latchpin 45 is identical to latchpin 41 used to lock bracing member 23 in the extended position such that the parts required to assemble the safety shield are minimized.

As shown in FIG. 1, bracing members 23 can also be arranged either horizontally or diagonally to provide rigidity to the shield and a so called "squaring-up" of the unit. The diagonal bracing members are identical to the horizontal bracing members in construction and operation except that they are made longer so as to be able to span the longer diagonal distance between the steps 5.

When the shield 1 is assembled as shown in FIG. 1, there is "play" in the unit due to the clearance between flanges 17 and 19 and the steps 5 and the oversized holes 7, 21 and 33. As a result, a small amount of movement is allowed between the various components to allow the component parts to be quickly and easily assembled or disassembled. If a compressive force is exerted on the sidewall members 13 by a cave-in of the dirt walls of the excavated trench, the force is transferred to the bracing members 23 via latchpins 45. As a result, the latchpins 45 are jammed between the sidewall members 13 and bracing members 23 such that the safety shield becomes rigid and resists the cave-in. In this situation the bracing members 23 and sidewall members 13 exert pressure on the latchpins 45 making them very difficult to remove. The pivoting bracing members 23 are designed to release the pressure on the latchpins 45 and allow their removal. By removing latchpin 41 and pulling on loop 43 the first section 25 and second section 27 fold toward one another such that distance between the clevis pivots 40 and 42 is shortened thereby reducing the pressure on latchpins 45 to allow the latchpins to be easily removed from the oversized holes 7, 21 and 33 during disassembly of the unit.

It should be noted that during assembly of the safety shield, some bracing members 23 could be installed before installing all of the sidewalls to thereby stabilize the columns as shown in FIG. 4. Moreover, the lower bracing members can also be installed before installing the upper sidewalls such that the safety shield is assembled one level at a time.

Because all of the components of the safety shield are made of aluminum, the heaviest component weighs only 55 pounds. Thus, the safety shield can be easily transported and assembled. Moreover, the safety shield can be assembled by hand without the need of any specialized tools or expensive equipment.

While the preferred embodiment of this invention has been shown and described in some detail, it is to be understood by one of ordinary skill in the art that this description and the accompanying drawings are offered merely by way of example, and that the invention is to be limited in scope only by the appended claims.

I claim:

1. A safety shield for a trench excavation comprising:

a plurality of support members;

a plurality of wall members supported by the support members;

at least one transverse bracing member arranged between said support members including a first section having a first end and a second end and a second section having a first end and a second end and means for pivotably connecting said first ends to one another; and a common means for engaging and joining said second ends of said support members, said wall members and said transverse members to one another.

2. The safety shield according to claim 1, wherein said means for joining includes portions of said support member, bracing member and wall member defining coextensive oversized holes and a means for engaging said holes.

3. The safety shield according to claim 1, wherein said support members include columns arranged in opposed pairs.

4. The safety shield according to claim 1, wherein each of said support members include a plurality of steps for supporting said wall members.

5. A safety shield for a trench excavation, comprising:

a plurality of vertical columns having a plurality of steps extending therefrom, portions of said steps defining at least one first hole;

a plurality of horizontal sidewall members supported by said steps and extending between adjacent vertical columns, portions of said sidewall members defining at least one second hole coextensive with said at least one first hole;

at least one transverse bracing member having portions defining at least one third hole and at least one fourth hole, said third hole being coextensive with one of said first and second holes and said fourth hole being coextensive with another one of said plurality of first and second holes; and a common means for engaging said first, second, third and fourth holes to secure said vertical columns, horizontal sidewalls and transverse bracing members to one another.

6. The safety shield according to claim 5, wherein said bracing includes a first section and a second section pivotably connected to one another.

7. The safety shield according to claim 6, wherein said bracing member includes a first clevis and second clevis pivotably mounted to said first section and second section, respectively, said first clevis having portions defining said third hole and said second clevis having portions defining said fourth hole.

8. The safety shield according to claim 6, further including means for preventing said first section from pivoting relative to said second section.

9. The safety shield according to claim 5, wherein the common means is a latchpin.

10. The safety shield according to claim 5, wherein the first, second, third and fourth holes are made oversized relative to said common means such that a loose fit results.

11. The safety shield according to claim 5, wherein said sidewall members are dimensioned such that a loose fit exists between the sidewall members and said steps.

* * * * *